United States Patent [19]

Hughes

[11] Patent Number: 4,723,465

[45] Date of Patent: Feb. 9, 1988

[54] BOTTLE CAP AND CAN TAB OPENER

[76] Inventor: Michael E. Hughes, 4717-A Lumber Ave. NE, Albuquerque, N. Mex. 87109

[21] Appl. No.: 944,350

[22] Filed: Dec. 18, 1986

Related U.S. Application Data

[63] Continuation-in-part of Ser. No. 798,577, Nov. 15, 1985, abandoned.

[51] Int. Cl.[4] ..... B67B 7/44

[52] U.S. Cl. ..... 81/3.09; 81/3.4; 81/3.55

[58] Field of Search ..... 81/3.09, 3.4, 124.3, 81/124.4, 3.55; 7/151; D8/18, 40

[56] References Cited

U.S. PATENT DOCUMENTS

| | | | |
|---|---|---|---|
| D. 277,635 | 2/1985 | Sherwood | D8/18 |
| D. 277,725 | 2/1985 | Silkebakken | D8/40 |
| D. 278,024 | 3/1985 | Hoffman et al. | D8/40 |
| 4,253,352 | 3/1981 | O'Neal | 81/3.55 |
| 4,309,921 | 1/1982 | Miller | 81/3.55 |
| 4,414,865 | 11/1983 | Brooks et al. | D8/40 |
| 4,416,171 | 11/1983 | Chmela et al. | 81/3.55 |
| 4,463,631 | 8/1984 | Barnes | 81/3.09 |
| 4,507,988 | 4/1985 | Lo Faso | 81/3.09 |

FOREIGN PATENT DOCUMENTS

| | | | |
|---|---|---|---|
| 2508499 | 9/1976 | Fed. Rep. of Germany | 81/3.55 |
| 599423 | 3/1948 | United Kingdom | 81/124.4 |

*Primary Examiner*—Roscoe V. Parker
*Attorney, Agent, or Firm*—Deborah A. Peacock

[57] ABSTRACT

A device for opening small and large bottled drinks having twist-off caps, and cans having pop-top tabs. The device has a handle, two different size back-to-back sockets on one end of the handle, a slot at the other end of the handle, and a projection at the end of the slot which engages with the fulcrum point or downward pushing end of the tab. The back-to-back sockets are useful in twisting off different size bottle caps. The slot and projection are useful in opening pop-top or tab-top cans. The preferred device of the invention has a punch hole for removing bottle caps which become lodged in the sockets, an additional socket at the slot end of the device, an extension with a hanging hole, and ribs on the handle for reinforcing the handle.

7 Claims, 8 Drawing Figures

BOTTLE CAP AND CAN TAB OPENER

CROSS REFERENCE TO A RELATED APPLICATION

This application is a continuation-in-part application of U.S. Pat. Application Ser. No. 798,577, entitled "A BOTTLE CAP AND CAN TAB OPENER," to Michael E. Hughes, filed on Nov. 15, 1985, now abandoned the teachings of which are incorporated herein by reference.

BACKGROUND OF THE INVENTION

This invention relates generally to container openers, and more particularly to multiple purpose bottle and tab-top can openers.

There are many openers in the prior art for opening bottles. One prior art opener, sometimes referred to as a "church key" is useful for removing crimped-on caps from bottles. This device has a handle and a loop. The loop is placed under the edge of the crimped-on cap and across the edge of the top of the crimped-on cap; the handle is used to lift the cap off of the bottle.

There are a variety of prior art openers for opening bottles having the more recent twist-off type caps. These prior art devices generally have one socket with serrations on the interior of the socket, such as disclosed in U.S. Pat. No. 4,414,865, entitled "BEVERAGE BOTTLE AND CAN OPENER," to Brooks et al.; U.S. Pat. No. Des. 277,635, entitled "OPENER FOR PULL-TAB CANS AND BOTTLES," to Sherwood; U.S. Pat. No. Des. 277,725, entitled "COMBINED BOTTLE AND CAN OPENER" to Silkebakken et al.; U.S. Pat. No. Des. 278,024, entitled "TAB TOP CAN OPENER," to Hoffman et al.; and U.S. Pat. No. 4,507,988 entitled "BEVERAGE RECEPTACLE OPENER," to LoFaso et al. U.S. Ser. No. 798,577 discloses a device having two sockets which are back to back, for twisting off different size bottle caps.

Prior art openers for cans are discussed below. One prior art opener for cans has a sharp V-shaped plunger which is manually inserted into the can. This type of opener is useful for cans which do not have the more recent pop-top type tabs.

There are a variety of prior art openers for pop-top type tabs on cans. Most of these prior art openers contain a slot at the end of or within a handle; the slot slides over the tab so that the tab can be lifted. Devices having such a slot are disclosed in the '865 patent; U.S. Pat. No. 4,416,171, entitled "TAB-TOP CAN OPENER," to Chmela et al; the '635 patent; the '024 patent; the '988 patent and U.S. Ser. No. 798,577. The '725 patent discloses a housing on the exterior of the handle which forms a slot for opening tab-top cans.

Several of the above-identified patents disclose projections at the end of the slot; these projections engage with the opening or covering portion of the pop-top tab which is pushed into the can. Such projections are disclosed in the '171 patent and the '988 patent. The other above-identified devices, which do not have this projection, will sometimes cause the tab to bend or break because the upper surface of the slot exerts a downward force on the upward lifting end of the tab. This bending or breaking is especially a problem with the more recent type of tabtops which have a round or rectangular projection and which prevent a user from sliding the slot completely into the tab. The handle of the '725 patent device forms an extended portion beyond the slot which engages only with the tab. This extended portion also causes bending or breaking of the tab because it applies a force on the edges of the tab.

Accordingly, it is a primary object of the present invention to provide an improved device for opening tab-top type cans which will not bend or break the tab, and which has improved leverage on the tab.

It is a further object of the present invention to provide a single device for opening two to three different size bottles as well as tab-top type cans.

Other objects and further scope of applicability of the present invention will become apparent from the detailed description to follow, taken in conjunction with the accompanying drawing.

SUMMARY OF THE INVENTION

This invention relates to an improved bottle cap and can tab opening device. The device is useful for opening bottles having varying sizes of twist-off caps and tab-top type cans.

The device of the invention comprises a handle, two different size back-to-back sockets for twisting off different size twistoff caps; and a slot having a projection for opening tab-top type cans. The interior of the sockets are serrated to provide better gripping capability. The projection engages with the fulcrum point or downward pushing end of the tab of the can during operation.

The device preferably further comprises the following: (1) An additional socket having a different size than the back-to-back sockets; (2) A punch hole between the back-to-back sockets for removing caps which become lodged in a socket; (3) An extension with a hanging hole; and (4) Ribs along the handle for strengthening or reinforcing the handle.

DESCRIPTION OF THE PREFERRED EMBODIMENT

Figure 1:
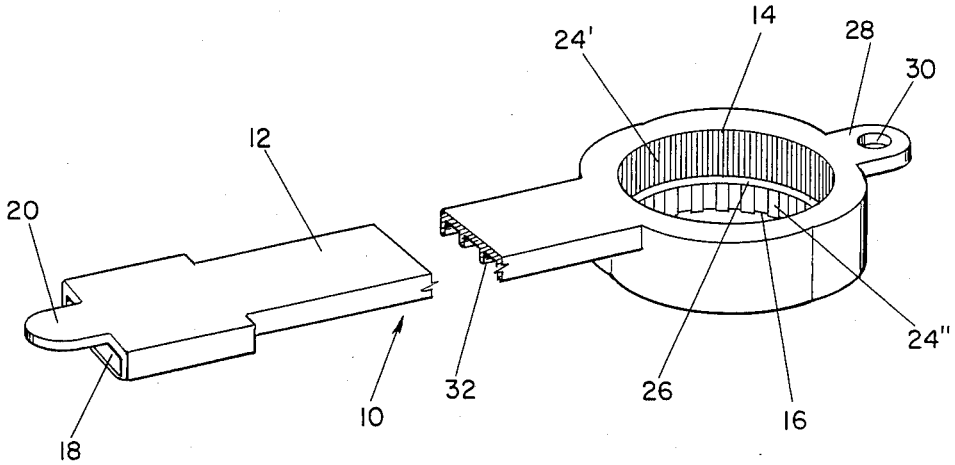
FIG. 1 is a top perspective cutaway view of the preferred device of the present invention.
Figure 2:
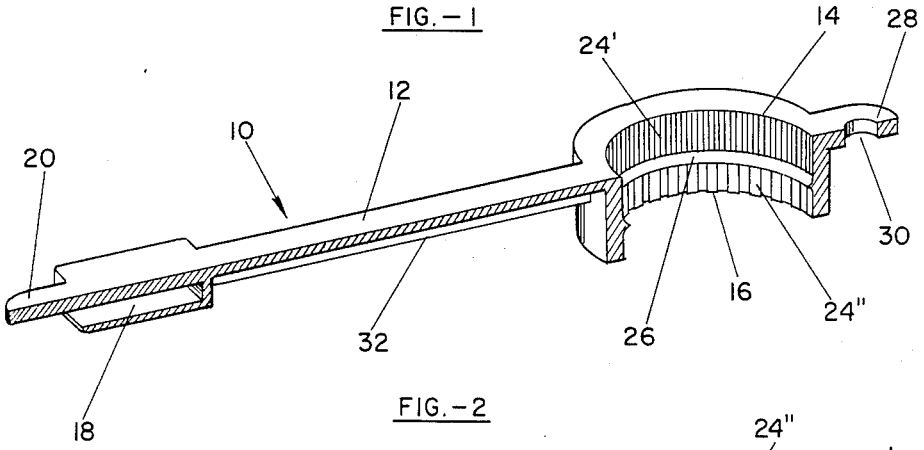
FIG. 2 is a cross sectional perspective view of the preferred device of the present invention of FIG. 1.
Figure 3:
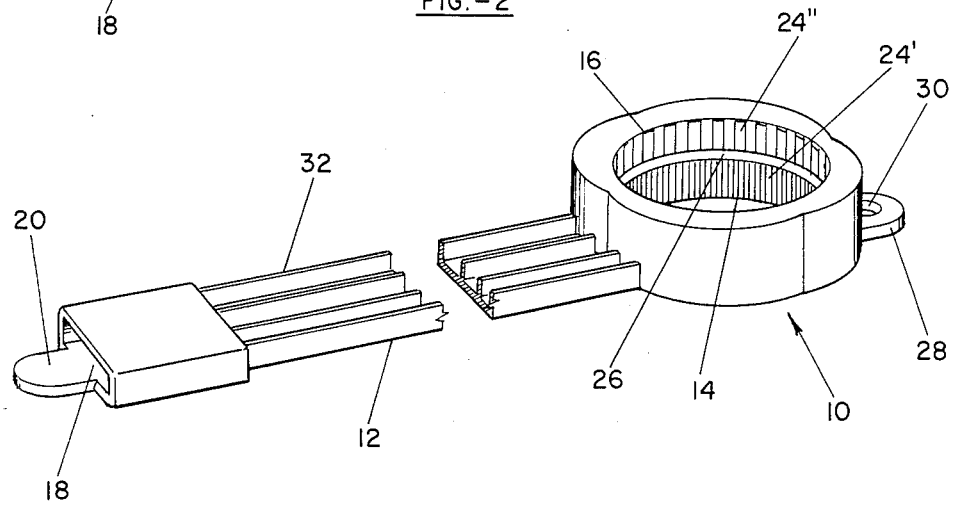
FIG. 3 is a bottom perspective cutaway view of the preferred device of the present invention of FIG. 1.
Figure 4:
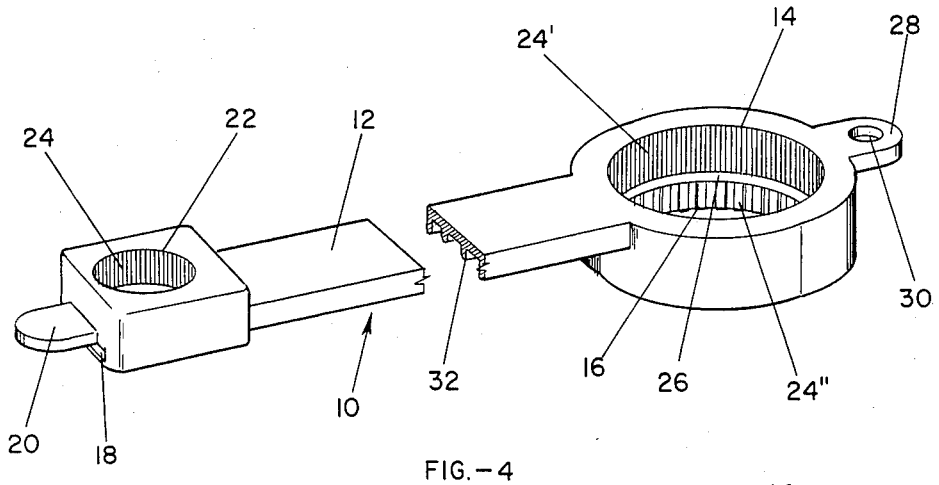
FIG. 4 is a top perspective cutaway view of an alternative embodiment of the present invention.
Figure 5:
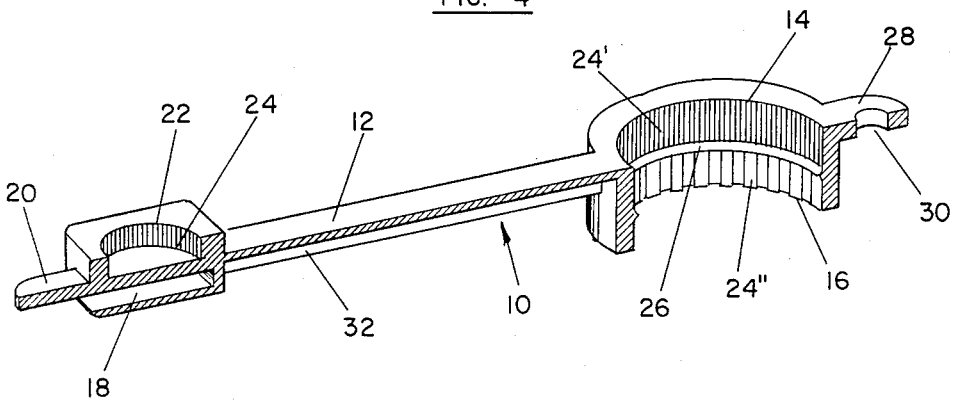
FIG. 5 is a cross sectional perspective view of the alternative embodiment of the present invention of FIG. 4.
Figure 6:
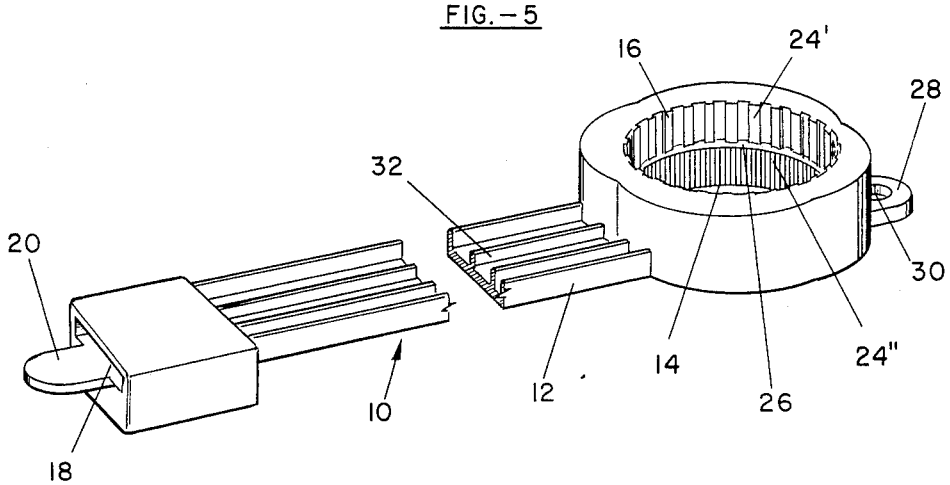
FIG. 6 is a bottom perspective cutaway view of the alternative embodiment of the present invention of FIG. 4.

This invention relates to an improved bottle and can opening device. FIGS. 1–3 and 7 illustrate the preferred device of the present invention, comprising two sockets for opening different size bottles, and a slot with a projection for opening tab-top type cans. FIGS. 4–6 and 8 illustrate an alternative embodiment of the invention having a third socket.

The device 10 of the invention comprises a handle 12, back-to-back sockets 14 and 16 positioned at one longitudinal end of the handle 12, and a slot 18 with a projection 20 positioned at the other longitudinal end of the handle 12. In an alternative embodiment (see FIGS. 4–6 and 8), the device 10 further comprises an additional socket 22 at the slot 18 end of the handle 12.

Each of the sockets 14, 16 and 20 have serrations or ribs 24, 24', and 24" for enhancing the gripping capability of the sockets 22, 16 and 14. Each socket has a different circumference from the other socket or sockets so that different size caps can be twisted off with the device 10.

During operation of the device 10 for opening bottles having twist-off caps, one socket on the device 10, which has a size corresponding to the size of the bottle cap, is placed over the bottle cap. The user uses the handle 12 to rotate the device 10 in a counterclockwise motion which thereby turns the bottle cap and opens the bottle.

The slot 18 at the end of the handle 12 comprises an upper surface 34 and a lower surface 36 (See FIGS. 7 and 8) which are parallel to each other and to the handle 12. At the outermost edge of the upper surface 34 of the slot 18 is the projection 20.

For purposes of clearly describing the device 10 of the invention and its relation to tab-top cans, the parts of the tab-top device are referred to as follows (see FIGS. 7 and 8): The tab-top device has two main parts; a handle or lever portion 38 and the opening or covering portion 40. The lever has a fixed hinge or fulcrum 44. A user applies an upward force to the upward lifting end 46 of the lever 38 by hand or with the aid of a device. This upward force, in turn, exerts a downward force on the downward pushing end 48 of the lever which thereby pushes the covering portion 40 of the tab-top into the can. The lever 38 is open or indented at the fulcrum point 44. Two edges or sides 50, 50, connect the upward lifting end 46 of the lever 38 to the downward pushing end 48 of the lever 38.

The projection 20 of the device 10 of the invention engages with the fulcrum area 44 or the downward pushing end 48 of the tab top. In prior art devices which have a projection, the projection engages with and pushes down on the opening 40 of the can or the side edges 50, 50', of the lever 38. The projection 20 of the device 10 of the present invention, on the other hand, engages with the fulcrum area 44 or the downward pushing end 48 of the lever 38. Thus, the projection 20 does not bend or break the lever 38, and the opening capability of the device 10 is improved. Another advantage of the device 10 of the present invention is that the device 10 never comes into direct contact with the beverage or liquid, such as with some prior art devices having projections. The projection 20 of the device 10 of the invention has a smaller width than the slot 18 so that it can fit into the indentation of the lever 38 at the fulcrum point 44 on some cans. The drawing shows a projection 20 which is rounded, although other shapes which can engage with the fulcrum area 44 or downward pushing end 48 may be utilized for the projection 20 of the device 10 of the invention.

Figure 7:
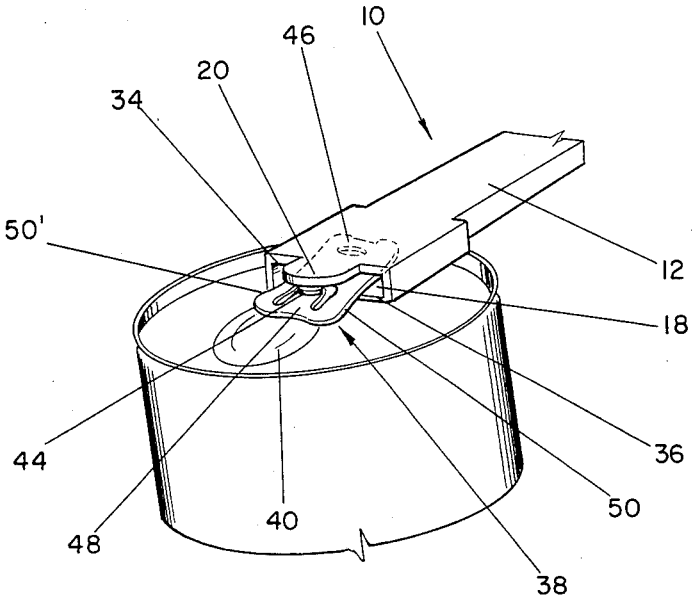
FIG. 7 is a perspective view of the preferred device of the present invention engaged with a square-ended tab-top type can.
Figure 8:
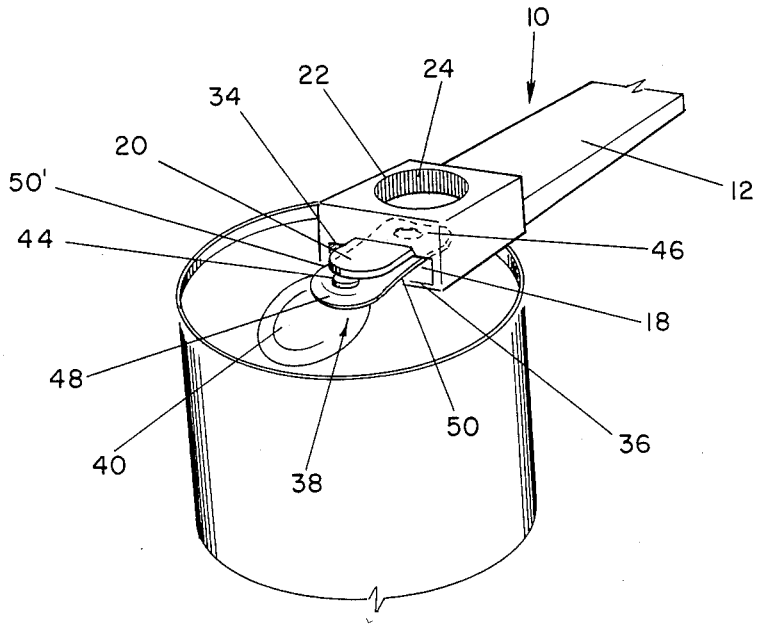
FIG. 8 is a perspective view of the alternative embodiment of the present invention engaged with a round-ended tab-top type can.

During operation of the device 10 for opening tab-top type cans, the slot 18 of the device 10 is slid onto the lever 38 so that the upper interior surface 34 of the slot 18 is positioned above the lever 38, and the lever 38 rests on and above the lower interior surface 36 of the slot 18. Before upward leverage is applied by the handle 12, the projection 20 is positioned above and does not contact the fulcrum 44 or the downward pushing end 48. When upward leverage is applied to the lever 38 by lifting the handle 12 upward, the slot causes an initial upward lifting of the upward lifting end 46 of the lever 38, the projection 20 engages with the fulcrum area 44 or downward pushing end 48 and the opening portion 40 is thereby pushed into the can by the downward pushing end 48 of the lever 38. The projection 20 does not contact the side edges 50, 50', of the lever 38, and thus will not bend or break the lever 38. Generally, the projection 20 engages with the downward pushing end 48 of tab-tops having square ends as shown in FIG. 7 and with the fulcrum area 44 of tab-tops having rounded ends as shown in FIG. 8.

Preferably, the device 10 further comprises a punch hole 26 between the back-to-back sockets 14 and 16. When one of these sockets 14 or 16 is used to twist off a bottle cap, the cap may become lodged in the socket 14 or 16. The punch hole 26 allows the user of the device 10 to push the cap out of the socket 14 or 16.

The device preferably further comprises an extension 28 with an opening 30 at the end of the handle 12 having the back-to-back sockets 14 and 16. This extension 28 and opening 30 allow the device 10 to be hung on a peg or nail. The handle 12 preferably comprises ribs 32 which serve to strengthen the handle 12. The handle 12 is of a sufficient length to provide enough average for a typical user to either twist off a bottle cap or lift up a pop-top tab.

The device is preferably made of any rigid type material such as metal, or a high quality engineering plastic such a polycarbonate, acrylic nitrite, butyl, styrene or nylon plastic.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A device for opening bottles having twist-off caps and cans having tab-top openers, wherein the tab-top opener of the can has a lever portion and a covering portion, and wherein the lever portion of the tab-top opener has a fulcrum point, side edges, an upward lifting end on one side of the fulcrum, and a downward pushing end on the other side of the fulcrum, and wherein the covering portion of the tab-top opener is the portion which is pushed into the can to open the can, comprising:

a. A handle which is generally long and thin;

b. A large socket and a small socket positioned on one longitudinal end of the handle, wherein said sockets are integrally formed with each other, back-to-back, and wherein the large socket and the small socket are sized to fit different-sized twist-off bottle caps, when provided, and wherein both sockets are generally circular and have serrations on their inside surfaces to better grip bottle caps;

c. A slot positioned on the other longitudinal end of the handle, said slot having an upper surface and a lower surface which are parallel and separated by a space, wherein the slot is sized to easily slide onto and accept the upward lifting end of the lever on a tab-top type can, when provided; and d. A projection having a narrower width than the slot, said projection extending outwardly and above the upper surface of the slot and which during operation supportedly engages with the fulcrum point or downward pushing end of the lever of a tab-top can, when provided, and which projection does not engage with the side edges of the lever or the covering portion of the can;

whereby during operation of the device for twisting off bottle caps, one of the sockets which corresponds to the size of the bottle cap is placed over the bottle cap and the handle is rotated in a counterclockwise direction thereby twisting off the cap and opening the bottle; and whereby during operation of the device for opening tab-top type cans, the slot is slid onto and around the upward lifting end of the lever so that the projection is positioned above the fulcrum point or the downward pushing end of the leaver, and the handle of the device is raised thereby lifting up the upward lifting end of the lever, engaging the projection with the fulcrum point or the downward pushing end, and causing a downward force on the downward pushing end of the lever which, in turn, pushes the covering portion of the can into the can, and thus opening the can.

2. A device in accordance with claim 1 further comprising an additional socket having a different circumference than the large socket and the small socket, wherein said additional socket is positioned above the upper surface of the slot on the slot end of the handle, and wherein said additional slot is generally circular and has serrations on its inside surface to better grip a bottle cap.

3. A device in accordance with claim 1 wherein the device further comprises a punch hole between the large socket and the small socket to assist in removing bottle caps lodged in said sockets.

4. A device in accordance with claim 1 further comprising an extension with an opening which extends outwardly from the socket end of the handle and serves as a hanging hole.

5. A device in accordance with claim 1 wherein the handle comprises ribs to reinforce the handle.

6. A device in accordance with claim 5 wherein said ribs are along the longitudinal axis of the handle.

7. A device in accordance with claim 1 which is made of quality engineering plastic.

* * * * *

UNITED STATES PATENT AND TRADEMARK OFFICE
Certificate

Patent No. 4,723,465 Patented: Feb. 9, 1988

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Michael E. Hughes and Robert W. Hughes.

Signed and Sealed this Twenty-ninth Day of October, 1991.

BRUCE M. KISLIUK

*Supervisory Patent Examiner*
*Art Unit 323*